US007683013B2

(12) United States Patent
Carey et al.

(10) Patent No.: US 7,683,013 B2
(45) Date of Patent: Mar. 23, 2010

(54) BASE STOCK LUBRICANT BLENDS FOR ENHANCED MICROPITTING PROTECTION

(75) Inventors: James T. Carey, Medford, NJ (US); David K. Prendergast, Chester, PA (US); Angela S. Galiano-Roth, Mullica Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 755 days.

(21) Appl. No.: 11/447,417

(22) Filed: Jun. 6, 2006

(65) Prior Publication Data

US 2006/0276355 A1 Dec. 7, 2006

Related U.S. Application Data

(60) Provisional application No. 60/688,086, filed on Jun. 7, 2005.

(51) Int. Cl.
*C10M 109/00* (2006.01)
*C10M 169/04* (2006.01)

(52) U.S. Cl. ..... 508/110

(58) Field of Classification Search ..... 508/315
See application file for complete search history.

(56) References Cited

U.S. PATENT DOCUMENTS

| | | | |
|---|---|---|---|
| 4,827,064 | A | 5/1989 | Wu |
| 4,827,073 | A | 5/1989 | Wu |
| 4,912,272 | A | 3/1990 | Wu |
| 4,956,122 | A | 9/1990 | Watts et al. |
| 4,990,711 | A | 2/1991 | Chen et al. |
| 5,105,038 | A | 4/1992 | Chen et al. |
| 5,180,865 | A | 1/1993 | Heilman et al. |
| 5,190,682 | A | 3/1993 | Harris |
| 5,315,053 | A | 5/1994 | Beach et al. |
| 5,436,379 | A | 7/1995 | Heilman et al. |
| 5,858,935 | A | 1/1999 | Watts et al. |
| 6,184,186 | B1 | 2/2001 | Ryan et al. |
| 6,713,438 | B1 | 3/2004 | Baillargeon et al. |
| 2003/0092585 | A1 | 5/2003 | O'Connor et al. |
| 2003/0158055 | A1 | 8/2003 | Deckman et al. |
| 2003/0207775 | A1 | 11/2003 | Sullivan et al. |
| 2004/0002429 | A1 | 1/2004 | Forbus, Jr. |
| 2005/0250657 | A1 | 11/2005 | Wu et al. |
| 2006/0122073 | A1 | 6/2006 | Hewette |

FOREIGN PATENT DOCUMENTS

| | | | |
|---|---|---|---|
| EP | 0 088 453 | B1 | 9/1983 |
| EP | 0 119 069 | A2 | 9/1984 |
| EP | 0 119 792 | A2 | 9/1984 |
| EP | 0119069 | A2 | 9/1984 |
| EP | 0119792 | A2 | 9/1984 |
| EP | 0088453 | B1 | 5/1987 |
| EP | 1 308 496 | B1 | 5/2003 |
| WO | WO 98/04658 | | 2/1998 |

OTHER PUBLICATIONS

ASTM D3427-03, "Standard Test Method for Air Release Properties of Petroleum Oils".
http://www.mobil.com/USA, Mobilgear® XMP Series.
http://www.famm 11 c.com/famm/lubricant_product.asp?gearoils &&wPinnacleMarineGear220, Pinnacle® Marine Gear 220.
D3427-03, "Standard Test Method for Air Release Properties of Petroleum Oils", ASTM International, May 30, 2006, pp. 1-5.

*Primary Examiner*—Glenn A Caldarola
*Assistant Examiner*—Taiwo Oladapo
(74) *Attorney, Agent, or Firm*—Gary P. Katz

(57) ABSTRACT

A lubricant formulation and method of blending a lubricant formulation is disclosed. The lubricant formulation comprises at least two base stocks. The first base stock comprises a viscosity greater than 100 cSt, Kv100° C. The second base stock comprises a viscosity less than 10 cSt, Kv100° C. The lubricant formulation provides excellent micropitting protection for gears including large gears that are used in wind turbines. In addition, the lubricant may also have a viscosity greater than 38 cSt (Kv 100° C.), a viscosity index greater than 161 and micropitting protection level of a FVA 54 micropitting Test Fail Load Stage greater than 10.

22 Claims, 3 Drawing Sheets

BASE STOCK LUBRICANT BLENDS FOR ENHANCED MICROPITTING PROTECTION

This application claims the benefit of U.S. Ser. No. 60/688,086 filed Jun. 7, 2005.

BACKGROUND

Micropitting is an unexpectedly high uniform rate of fatigue wear. It occurs in rolling sliding Elasto Hydrodynamic Lubrication ("EHL") contact during the first million rotation cycles of machine life. The affected gears typically have a gray matte finish on the contact surfaces with microscopic examination revealing a network of cracks and micropits 10 to 20 micrometers in diameter. This type of failure has been a chronic problem with large gearboxes including the gearboxes used in the wind turbine industry. Micropits coalesce to produce a continuous fractured surface with a characteristic dull matte appearance variously called gray staining, frosting, or, in German, graufleckigkeit when applied to gears. The related term for the phenomenon in bearings is peeling or general superficial spalling. Micropitting is generally, but not necessarily exclusively, a problem associated with heavily loaded case carburized gearing.

The progression of micropitting may eventually result in (macro)pitting, or it may progress to a point and stop. Although it may appear innocuous, such loss of metal from the gear surface causes loss of gear accuracy, increased vibration and noise, and other related problems.

Methods for measuring micropitting of gears have been developed at the FZG Institute in Munich more than a decade ago. See "Influence of the Lubricant on Pitting and Micro Pitting. Resistance of Case Carburized Gears—Test Procedures" Winter, H; Oster, P. AGMA Technical Paper 87 FTM 9, October 1987. The FZG approach was subsequently developed into a procedure sponsored by the FVA association in Germany and formally published in 1993. See "FVA-Informationsblatt Nr. 54 I-IV:Testverfahren zur Untersuchung des Schmierstoffeinflusses auf die Entstehung von Grauflecken bei Zahnradern" FVA-Nr. 54/7 Stand Juli 1993.

The FVA 54/7 procedure has become the industry standard for assessing industrial gear lubricant micropitting-resistance performance. The method uses the FZG power-circulating equipment that has two separate stages. First, a progressive loading test or stage test in which the pinion or smaller of the two gears in a set must be dismounted and rated after each 16-hour load stage from load stage 5 through load stage 10. Then the second side of the gear set is run in a stage test involving load stages 5 through 10 each 16 hours long with fresh oil. This is followed by the endurance test in which the gear is run with the same oil charge as the second stage test for a total of six 80-hour periods starting at load stage 8 for the first 80 hours, and then finishing at load stage 10 for subsequent 80 hour periods. Inspections are performed between each period. The inspections assess micropitted area of the pinion tooth flanks, pinion weight loss and the deviation of profile form. Tooth profile measurement is carried out through use of a profilometer. The sensing tip is moved from tooth tip to root and the topography is fed into a computer program. The before and after test measurements are compared and the difference reported as "profile deviation". The damage load stage is reached when the profile deviation exceeds 7.5 μm.

Mobilgear Synthetic HydroCarbon-Xtra Micro Protection or ("SHC XMP") sold by ExxonMobil Corporation in Fairfax Va., was commercialized in 1998 as a micropitting resistant industrial gear oil. The primary market for this lube is the wind turbine industry. Mobilgear SHC XMP was very successful in use with one exception. That exception is the superior level of performance demanded by builders today in the, Graufleckigkeit Test "GFT" FLS greater than 10 Class High. GFT Class High is a rating requiring a FLS greater than 10. Mobilgear SHC XMP 320 provides a FLS equal to 10 high. Currently, only the BP Castrol Optimol Synthetic A 320 product claims this equivalent level of micropitting performance.

In the last several years, there has been a number of key equipment builders in this sector that are starting to require the highest level of performance in the FVA 54 Micropitting test of FLS greater than 10. A high FLS greater than 10 high rating require less than 7.5 microns of gear tooth profile deviation in the FVA 54 Micropitting test at the end of stage 10 loads. At the current time, there are no known hydrocarbon based lubes that consistently give this level of performance. Accordingly, there is a need for a lubricant that provides a consistent FVA 54 Micropitting test result of FLS greater than 10 high. The present invention satisfies this need by providing a novel combination of base stocks that give the desired performance.

SUMMARY

A novel lubricant formulation is disclosed. In one embodiment the novel lubricant formulation comprises at least two base stocks with a viscosity difference between the first and the second base stocks greater than 96 cSt, Kv100° C., and the lubricating oil provides a FVA 54 Micropitting Test is Fail Load greater than 8.

In a second embodiment, the novel lubricant formulation comprises at least two base stocks. The first base stock comprising synthetic oil with a viscosity greater than 100 cST, Kv100° C. The second base stock comprising synthetic oil with a viscosity less than 10 cST, Kv100° C.

A method for blending a novel formulation is also disclosed. The method comprises obtaining a first synthetic base stock lubricant. The first base stock having a viscosity greater than 100 cSt, Kv100° C. A second synthetic base stock lubricant is obtained. The second base stock lubricant has a viscosity less than 10 cSt, Kv100° C. The first and second base stock lubricants are mixed to produce the lubricating oil wherein the lubricating oil to provide a FVA 54 Micropitting Test Fail Load greater than 8.

A method of achieving favorable micropitting protection is also disclosed. The method comprising obtaining a lubricating oil comprising at least two base stocks, at least 10 percent and no more than 60 percent of a first base stock comprising a synthetic oil with a viscosity greater than 100 cSt, Kv100° C., at least 5 percent and no more than 30 percent of a second base stock comprising a oil with a viscosity less than 10 cSt, Kv100° C., wherein the lubrication oil provides a FVA 54 Micropitting Test Fail Load Stage greater than 8 and lubricating at least one gear with the lubricating oil.

DETAILED DESCRIPTION

Figure 1:
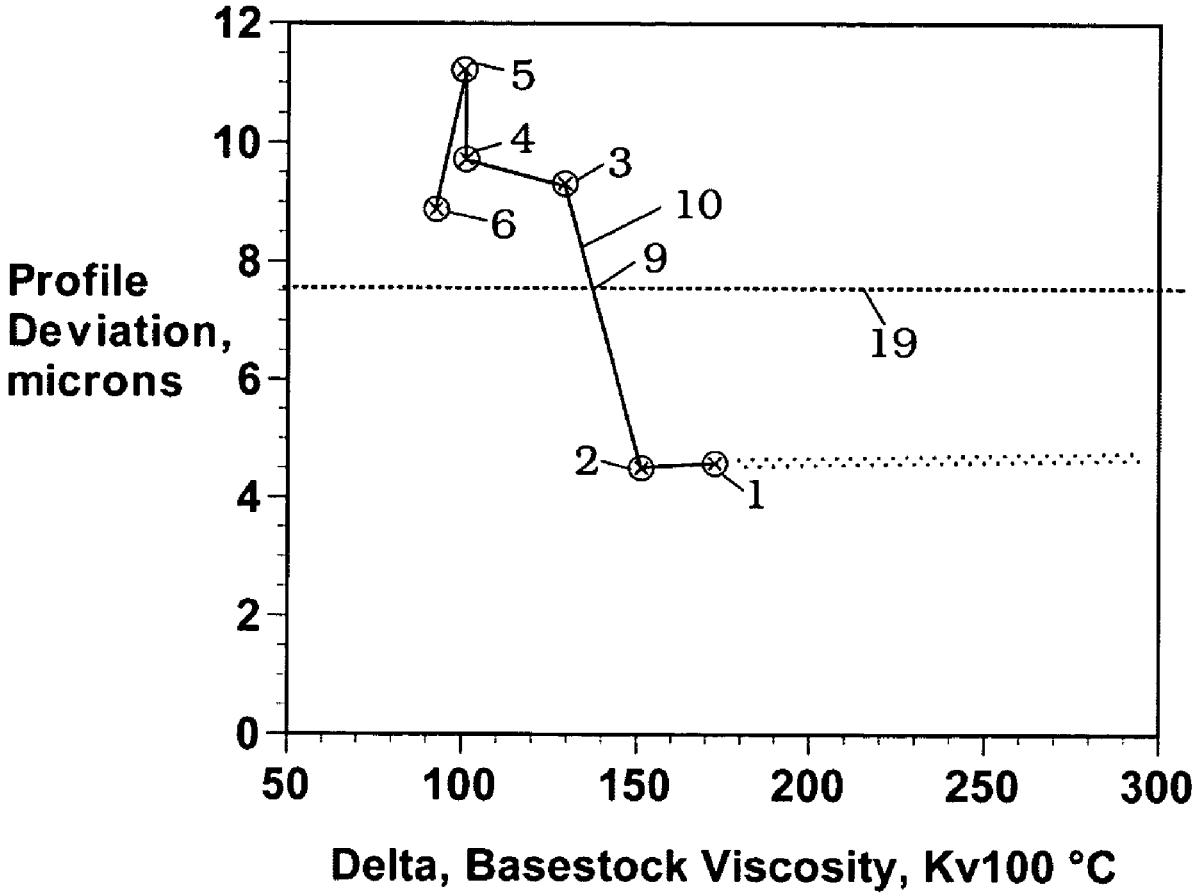
FIG. 1 is a graph showing the gear tooth profile deviation based on the viscosity delta in the blended base stocks.

We have discovered a novel combination of base stocks that provides an unexpected increase in micropitting protection. The enhanced micropitting benefit was demonstrated in a modified FVA 54 type micropitting test and in the actual FVA 54 type micropitting test. The micropitting performance level has achieved a consistent Fail Load Stage Greater than 10. Hydrocarbon based lubes have historically not been able to reach a Fail Load Stage of greater than 10 in the FVA 54 micropitting test.

In one embodiment, this novel discovery is based on wide "bi-modal" blends of oil viscosities which are base stock viscosity differences of at least 96 cSt, Kv100° C. Kinematic Viscosity is determined by measuring the time for a volume of liquid to flow under gravity through a calibrated glass capillary viscometer. Viscosity is typically measured in centistokes (cSt, or $mm^2/s$) units. The ISO viscosity classification which is typically cited for industrial lubes of finished lubricants based on viscosities observed at 40° C. Base stock oils used to blend finished oils, are generally described using viscosities observed at 100° C. This "bi-modal" blend of viscosities also provides a temperature benefit by lowering the lubricant temperature in gear testing by approximately 10° C. This temperature drop would provide increased efficiency boosts.

The lubricant oil comprises at least two base stock blends of oil. The first base stock blend comprises lubricant oil with a viscosity of over 100 cSt, Kv100° C. More preferably the first base stock viscosity is below 300 cSt, Kv100° C. to avoid instability issues due to rapid mechanical shearing. Even more preferable is a first base stock blend with a viscosity greater than 110 cSt, Kv100° C. and less than 200 cSt, Kv100° C. and most preferably is a viscosity between 120 and 200 cSt, Kv100° C.

The second base stock blend comprises lubricant oil with a viscosity of less than 10 cSt, Kv100° C. and preferably less than 6 cSt, Kv100° C. Preferably the viscosity of the second lubricant should preferably be at least 2 cSt, Kv100° C. Even more preferable is a viscosity of between 3 and 5 cSt, Kv100° C. Table 1 is micropitting test data for both conventional gear oil formulations as well as novel bi-modal blends. The data is illustrated in the FIGS. 1, 2 and 3 graphs.

TABLE 1

| Data Point | Kv 40, cSt | Kv 100, cSt | Viscosity Index | Profile Dev, microns | Delta BS visc., Kv100 |
|---|---|---|---|---|---|
| 1 | 307.0 | 41.28 | 190 | 4.6 | 146 |
| 2 | 350.8 | 43.60 | 181 | 4.5 | 121 |
| 3 | 335.0 | 37.60 | 161 | 9.3 | 94 |
| 4 | 321.7 | 34.41 | 151 | 9.7 | 60 |
| 5 | 308.4 | 33.97 | 154 | 11.2 | 60 |
| 6 | 316.6 | 23.91 | 96 | 8.9 | 50 |

FIG. 1 is a graph showing the teeth gear profile deviation line 10 based on the delta in viscosity in the first and second blended base stocks. As shown in this graph the wide difference in viscosities provides improved micropitting protection breaking through the FLS greater than 10 barrier as represented by line 19. At data point 3 with a viscosity difference of 94 cSt, Kv100° C. between the first and second base stocks there is no improvement over the prior art. However, at data point 2 with a viscosity difference of 124 cSt, Kv100° C. between the first and second base stocks there is a significant improvement in micropitting protection. The crossover point 9 from the FLS=10 region 11 into the FLS greater than 10 region 11 occurs at approximately 103 cSt, Kv100° C. The improvement in micropitting protection begins at a difference of 96 cSt, Kv100° C. between the first and second base stocks and continues until approximately 300 cSt, Kv100° C. A more preferred range is between 100 cSt, Kv100° C. and 250 cSt, Kv100° C. The most preferred range in viscosity differences appears to be between approximately 125 and 150 cSt, Kv100° C.

Figure 2:
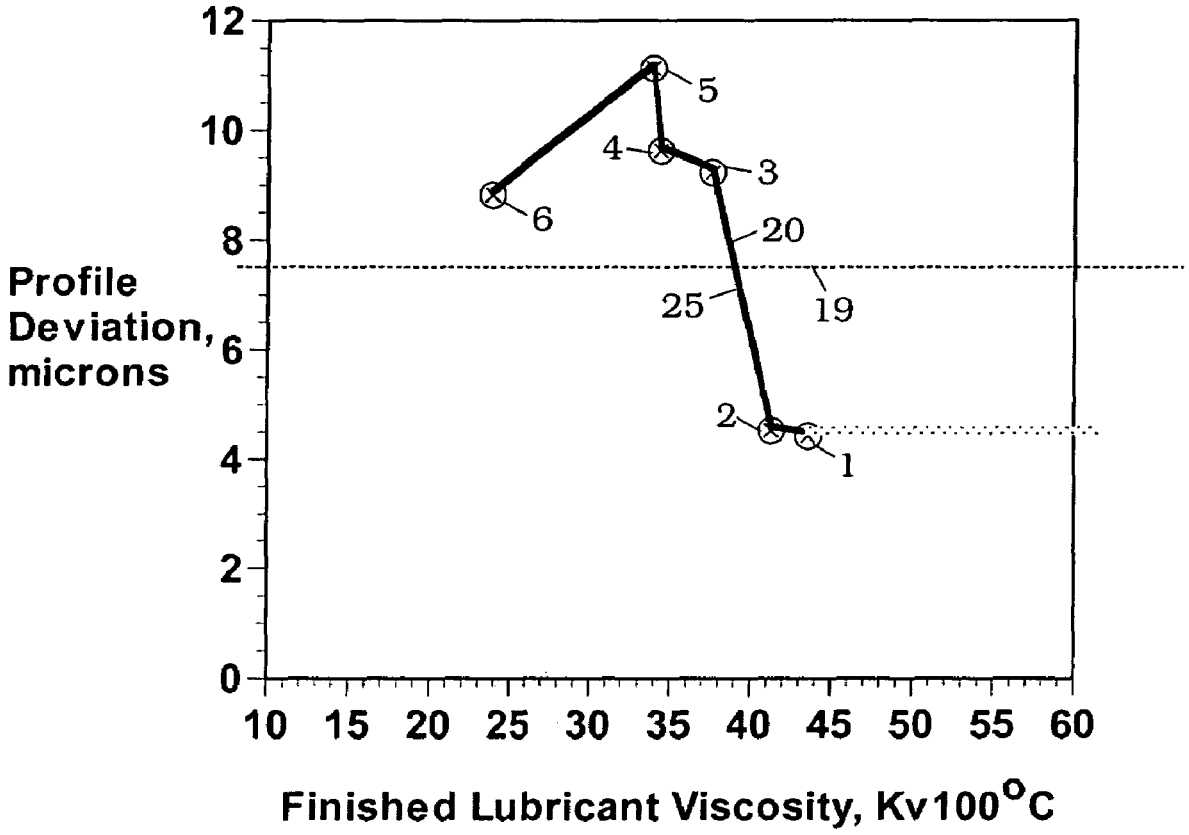
FIG. 2 is a graph showing the gear tooth profile deviation based on the final viscosity in the in the lubricating oil from the blended base stocks.

FIG. 2 is a graph showing the gear tooth profile line 20 deviation based on the final viscosity in the blended base stocks wherein similar elements in FIG. 1 have been assigned the same reference numerals. This graph shows the final viscosity of the lubricating oils after the base stocks have been blended to be within ISO 320 (Kv 40° C.) grade.

As shown in FIG. 2, the higher viscosities provides improved micropitting protection breaking through the FLS greater than 10 barrier as represented by line 19. At data point 3 with a viscosity 38 cSt, Kv100° C. there is no improvement over the prior art. However, at data point 2 with a viscosity of 44 cSt, Kv100° C. there is a significant improvement in micropitting protection. The crossover point 25 from the FLS=10 region 11 into the FLS greater than 10 region 11 occurs at approximately 40 cSt, Kv100° C. The improvement in micropitting protection begins at a viscosity of approximately 39 cSt, Kv100° C. and continues until approximately 300 cSt, Kv100° C. A more preferred range is between 40 cSt, Kv100° C. and 100 cSt, Kv100° C.

Figure 3:
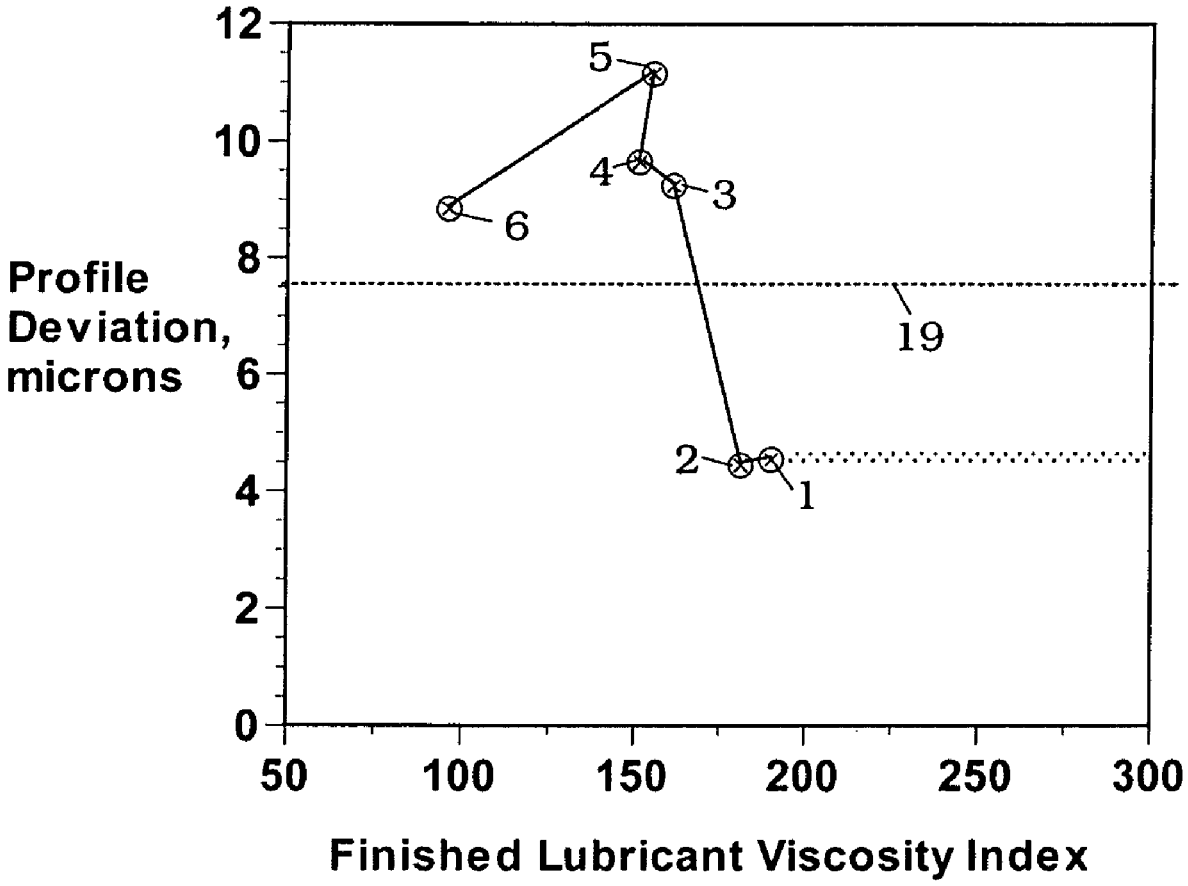
FIG. 3 is a graph showing the gear tooth profile deviation based on the final Viscosity Index in the lubricating oil from the blended base stocks.

FIG. 3. is a graph showing the gear tooth profile 30 deviation based on the final Viscosity Index or ("VI") of lubricating oil from the blended base stocks wherein similar elements in FIGS. 1 and 2 have been assigned the same reference numerals. The VI Practice, as described in ASTM standard D2270, is a widely used and accepted measure of the variation in kinematic viscosity due to changes in the temperature of a petroleum product between 40° C. and 100° C. A higher Viscosity Index indicates a smaller decrease in viscosity as temperature increases. The VI is also used as a single number showing the dependence of kinematic viscosity due to temperature change.

As shown in FIG. 3, the higher VI provides improved micropitting protection breaking through the FLS greater than 10 barrier as represented by line 19. At data point 3 with a VI of 161 there is no micropitting improvement over the prior art. However, at data point 2 with a VI of 181 there is a significant improvement in micropitting protection. The crossover point 35 from the FLS=10 region 11 into the FLS greater than 10 region 11 occurs at approximately 168 VI. The improvement in micropitting protection begins at a VI of approximately 165 and continues until a VI of approximately 300. The micropitting protection should continue past a VI of 300.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and/or less than about 90% saturates. Group II base stocks generally have a viscosity index of between about 80 to 120, and contain less than or equal to about 0.03% sulfur and greater than or equal to about 90% saturates. Group III stock generally has a viscosity index greater than about 120 and contains less than or equal to about 0.03% sulfur and greater than about 90% saturates. Group IV includes polyalphaolefins (PAO). Group V base stocks include base stocks not included in Groups I-IV. Table 2 summarizes properties of each of these five groups.

TABLE 2

| Base Stock Properties | | | |
|---|---|---|---|
| | Saturates | Sulfur | Viscosity Index |
| Group I | <90% and/or | >0.03% and | ≧80 and <120 |
| Group II | ≧90% and | ≦0.03% and | ≧80 and <120 |
| Group III | ≧90% and | ≦0.03% and | ≧120 |
| Group IV | Polyalphaolefins (PAO) | | |
| Group V | All other base oil stocks not included in Groups I, II, III, or IV | | |

In a preferred embodiment, the base stocks include at least one base stock of synthetic oils and most preferably include at least one base stock of API group IV Poly Alpha Olefins. Synthetic oil for purposes of this application shall include all oils that are not naturally occurring mineral oils. Naturally occurring mineral oils are often referred to as API Group I oils.

A new type of PAO lubricant was introduced by U.S. Pat. Nos. 4,827,064 and 4,827,073 (Wu). These PAO materials, which are produced by the use of a reduced valence state chromium catalyst, are olefin oligomers or polymers which are characterized by very high viscosity indices which give them very desirable properties to be useful as lubricant basestocks and, with higher viscosity grades; as VI improvers. They are referred to as High Viscosity Index PAOs or HVI-PAOs. The relatively low molecular weight HVI-PAO materials were found to be useful as lubricant basestocks whereas the higher viscosity PAOs, typically with viscosities of 100 cSt or more, e.g. in the range of 100 to 1,000 cSt, were found to be very effective as viscosity index improvers for conventional PAOs and other synthetic and mineral oil derived basestocks.

Various modifications and variations of these HVI-PAO materials are also described in the following U.S. Patents to which reference is made: U.S. Pat. Nos. 4,990,709; 5,254,274; 5,132,478; 4,912,272; 5,264,642; 5,243,114; 5,208,403; 5,057,235; 5,104,579; 4,943,383; 4,906,799. These oligomers can be briefly summarized as being produced by the oligomerization of 1-olefins in the presence of a metal oligomerization catalyst which is a supported metal in a reduced valence state. The preferred catalyst comprises a reduced valence state chromium on a silica support, prepared by the reduction of chromium using carbon monoxide as the reducing agent. The oligomerization is carried out at a temperature selected according to the viscosity desired for the resulting oligomer, as described in U.S. Pat. Nos. 4,827,064 and 4,827,073. Higher viscosity materials may be produced as described in U.S. Pat. No. 5,012,020 and U.S. Pat. No. 5,146,021 where oligomerization temperatures below about 90° C. are used to produce the higher molecular weight oligomers. In all cases, the oligomers, after hydrogenation when necessary to reduce residual unsaturation, have a branching index (as defined in U.S. Pat. Nos. 4,827,064 and 4,827,073) of less than 0.19. Overall, the HVI-PAO normally have a viscosity in the range of about 12 to 5,000 cSt.

Furthermore, the HVI-PAOs generally can be characterized by one or more of the following: C30-C1300 hydrocarbons having a branch ratio of less than 0.19, a weight average molecular weight of between 300 and 45,000, a number average molecular weight of between 300 and 18,000, a molecular weight distribution of between 1 and 5. Particularly preferred HVI-PAOs are fluids with 100° C. viscosity ranging from 5 to 5000 cSt. In another embodiment, viscosities of the HVI-PAO oligomers measured at 100° C. range from 3 centistokes ("cSt") to 15,000 cSt. Furthermore, the fluids with viscosity at 100° C. of 3 cSt to 5000 cSt have VI calculated by ASTM method D2270 greater than 130. Usually they range from 130 to 350. The fluids all have low pour points, below −15° C.

The HVI-PAOs can further be characterized as hydrocarbon compositions comprising the polymers or oligomers made from 1-alkenes, either by itself or in a mixture form, taken from the group consisting of C6-C20 1-alkenes. Examples of the feeds can be 1-hexene, 1-octene, 1-decene, 1-dodecene, 1-tetradecene, etc. or mixture of C6 to C14 1-alkenes or mixture of C6 to C20 1-alkenes, C6 and C12 1-alkenes, C6 and C14 1-alkenes, C6 and C16 1-alkenes, C6 and C18 1-alkenes, C8 and C10 1-alkenes, C8 and C12 1-alkenes, C8, C10 and C12 1-alkenes, and other appropriate combinations.

The lube products usually are distilled to remove any low molecular weight compositions such as theose boiling below 600° F., or with carbon number less than C20, if they are produced from the polymerization reaction or are carried over from the starting material. This distillation step usually improves the volatility of the finished fluids. In certain special applications, or when no low boiling fraction is present in the reaction mixture, this distillation is not necessary. Thus the whole reaction product after removing any solvent or starting material can be used as lube base stock or for the further treatments.

The lube fluids made directly from the polymerization or oligomerization process usually have unsaturated double bonds or have olefinic molecular structure. The amount of double bonds or unsaturation or olefinic components can be measured by several methods, such as bromine number (ASTM 1159), bromine index (ASTM D2710) or other suitable analytical methods, such as NMR, IR, etc. The amount of the double bond or the amount of olefinic compositions depends on several factors—the degree of polymerization, the amount of hydrogen present during the polymerization process and the amount of other promoters which participate in the termination steps of the polymerization process, or other agents present in the process. Usually, the amount of double bonds or the amount of olefinic components is decreased by the higher degree of polymerization, the higher amount of hydrogen gas present in the polymerization process, or the higher amount of promoters participating in the termination steps.

It was known that, usually, the oxidative stability and light or UV stability of fluids improves when the amount of unsaturation double bonds or olefinic contents is reduced. Therefore it is necessary to further hydrotreat the polymer if they have high degree of unsaturation. Usually, the fluids with bromine number of less than 5, as measured by ASTM D1159, is suitable for high quality base stock application. Of course, the lower the bromine number, the better the lube quality. Fluids with bromine number of less than 3 or 2 are common. The most preferred range is less than 1 or less than 0.1. The method to hydrotreat to reduce the degree of unsaturation is well known in literature [U.S. Pat. No. 4,827,073, exaple 16). In some HVI-PAO products, the fluids made directly from the polymerization already have very low degree of unsaturation, such as those with viscosities greater than 150 cSt at 100° C. They have bromine numbers less than 5 or even below 2. In these cases, we can chose to use as is without hydrotreating, or we can choose to hydrotreating to further improve the base stock properties.

Base stocks having a high paraffinic/naphthenic and saturation nature of greater than 90 weight percent can often be used advantageously in certain embodiments. Such base stocks include Group II and/or Group III hydroprocessed or hydrocracked base stocks, or their synthetic counterparts such as polyalphaolefin oils, GTL or similar base oils or mixtures of similar base oils. For purposes of this application synthetic bases stocks shall include Group II, Group III, group IV and Group V base stocks.

A more specific example embodiment, is the combination of High Viscosity Index PAO, or as an example, SPECTRA SYN ULTRA™ (150 cSt, Kv100° C.) and a low viscosity Poly Alpha Olefin ("PAO") including PAOs with a viscosity of less than 6 cSt, Kv100° C. and more preferably with a viscosity between 2 and 4 (2 cSt or 4 cSt, Kv100° C.) and even more preferably with a small amount of esters or alkylated aromatics. The esters including esters or alkylated aromatics can be used as an additional base stock or as a co-base stock with either the first and second base stocks for additive solubility. High viscosity index PAO or SPECTRA SYN ULTRA 150 is a high viscosity synthetic lubricant oil and is a commercially available lubricant sold by ExxonMobil Corporation in Fairfax Va. while esters and PAOs are commercially available commodity lubricants. The preferred ester is an alkyl adipate.

Gas to liquid base stocks can also be preferentially used with the components of this invention as a portion or all of the base stocks used to formulate the finished lubricant. We have discovered, favorable improvement when the components of this invention are added to lubricating systems comprising primarily Group II, Group III and/or GTL base stocks compared to lesser quantities of alternate fluids.

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) include oils boiling in the lube oil boiling range separated/fractionated from GTL materials such as by, for example, distillation or thermal diffusion, and subsequently subjected to well-known catalytic or solvent dewaxing processes to produce lube oils of reduced/low pour point; wax isomerates, comprising, for example, hydroisomerized or isodewaxed synthesized hydrocarbons; hydro-isomerized or isodewaxed Fischer-Tropsch ("F-T") material (i.e., hydrocarbons, waxy hydrocarbons, waxes and possible analogous oxygenates); preferably hydroisomerized or isodewaxed F-T hydrocarbons or hydroisomerized or isodewaxed F-T waxes, hydroisomerized or isodewaxed synthesized waxes, or mixtures thereof.

GTL base stock(s) derived from GTL materials, especially, hydroisomerized/isodewaxed F-T material derived base stock(s), and other hydroisomerized/isodewaxed wax derived base stock(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the isodewaxing of F-T wax, which has a kinematic viscosity of about 4 $mm^2/s$ at 100° C. and a viscosity index of about 130 or greater. The term GTL base oil/base stock and/or wax isomerate base oil/base stock as used herein and in the claims is to be understood as embracing individual fractions of GTL base stock/base oil or wax isomerate base stock/base oil as recovered in the production process, mixtures of two or more GTL base stocks/base oil fractions and/or wax isomerate base stocks/base oil fractions, as well as mixtures of one or two or more low viscosity GTL base stock(s)/base oil fraction(s) and/or wax isomerate base stock(s)/base oil fraction(s) with one, two or more high viscosity GTL base stock(s)/base oil fraction(s) and/or wax isomerate base stock(s)/base oil fraction(s) to produce a bi-modal blend wherein the blend exhibits a viscosity within the aforesaid recited range. Reference herein to Kinematic Viscosity refers to a measurement made by ASTM method D445.

GTL base stocks and base oils derived from GTL materials, especially hydroisomerized/isodewaxed F-T material derived base stock(s), and other hydroisomerized/isodewaxed wax-derived base stock(s), such as wax hydroisomerates/isodewaxates, which can be used as base stock components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step may be practiced to achieve the desired pour point. References herein to pour point refer to measurement made by ASTM D97 and similar automated versions.

The GTL base stock(s) derived from GTL materials, especially hydroisomerized/isodewaxed F-T material derived base stock(s), and other hydroisomerized/isodewaxed wax-derived base stock(s) which are base stock components which can be used in this invention are also characterized typically as having viscosity indices of 80 or greater, preferably 100 or greater, and more preferably 120 or greater. Additionally, in certain particular instances, viscosity index of these base stocks may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270.

In addition, the GTL base stock(s) are typically highly paraffinic of greater than 90 percent saturates) and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than about 10 ppm, and more typically less than about 5 ppm of each of these elements. The sulfur and nitrogen content of GTL base stock and base oil obtained by the hydroisomerization/isodewaxing of F-T material, especially F-T wax is essentially nil.

In a preferred embodiment, the GTL base stock(s) comprises paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s), hydroisomerized or isodewaxed F-T material derived base stock(s), and wax-derived hydroisomerized/isodewaxed base stock(s), such as wax isomerates/isodewaxates, are recited in U.S. Pat. Nos. 6,080,301; 6,090,989, and 6,165,949 for example.

We have discovered that this unique base stock combination can impart even further enhanced micropitting protection when combined with specific additive systems. The additives include various commercially available gear oil packages. These additive packages include a high performance series of components that include antiwear, antioxidant, defoamant, demulsifier, detergent, dispersant, metal passivation, and rust inhibition additive chemistries to deliver desired performance.

The additives may be chosen to modify various properties of the lubricating oils. For wind turbines, the additives should provide the following properties, antiwear protection, rust protection, micropitting protection, friction reduction, and improved filterability. Persons skilled in the art will recognize various additives that can be chosen to achieve favorable properties including favorable properties for wind turbine gears.

The final lubricant should comprise a first lubricant base stock having a viscosity of greater than 100 cSt, Kv100° C. The first lubricant base stock should comprise of at least 40 percent and no more than 80 percent of the final lubricant. The second base stock having a viscosity less than 10 cSt should comprise at least 20 percent and no more than 60 percent of the final base stock total. The amount of ester and/or additive can be up to 90 percent of the final lubricant total with a proportional decrease in the acceptable ranges of first and second base stocks. The preferred range of esters and additives is between 10 and 90 percent.

A more preferred lubricant should comprise a first base stock with a viscosity of greater than 150 cSt, Kv100° C., the first base stock representing at least 10 percent of the final product and no more than 60 percent of the final lubricant. The second base stock is a PAO with a viscosity between 2 and 10 cSt, Kv100° C. and representing at least five percent of the final product and no more than 30 percent of the final product. An optional additional base stock includes a base stock with a viscosity of at least 6 cSt but no more than 100 cSt, Kv100° C. representing a range of between 0 and less than 65 percent of the final lubricant product. An ester additive package may range from 5 percent up to 25 percent of the final lubricant product.

The preferred ashless antioxidants are hindered phenols and arylamines. Typical examples are butylated/octylated/styrenated/nonylated/dodecylated diphenylamines, 4,4'-methylene bis-(2,6-di-tert-butylphenol), 2,6-di-tert-butyl-p-cresol, octylated phenyl-alpha-naphthylamine, alkyl ester of 3,5-di-tert-butyl-4-hydroxy-phenyl propionic acid, and many others. Sulfur-containing antioxidants, such as sulfur linked hindered phenols and thiol esters can also be used.

Suitable dispersants include borated and non-borated succinimides, succinic acid-esters and amides, alkylphenol-polyamine coupled Mannich adducts, other related components and any combination thereof. In some embodiments, it can often be advantageous to use mixtures of such above described dispersants and other related dispersants. Examples include additives that are borated, those that are primarily of higher molecular weight, those that consist of primarily mono-succinimide, bis-succinimide, or mixtures of above, those made with different amines, those that are end-capped, dispersants wherein the back-bone is derived from polymerization of branched olefins such as polyisobutylene or from polymers such as other polyolefins other than polyisobutylene, such as ethylene, propylene, butene, similar dispersants and any combination thereof. The averaged molecular weight of the hydrocarbon backbone of most dispersants, including polyisobutylene, is in the range from 1000 to 6000, preferably from 1500 to 3000 and most preferably around 2200.

Suitable detergents include but are not limited to calcium phenates, calcium sulfonates, calcium salicylates, magnesium phenates, magnesium sulfonates, magnesium salicylates, metal carbonates, related components including borated detergents, and any combination thereof. The detergents can be neutral, mildly overbased, or highly overbased. The amount of detergents usually contributes a total base number (TBN) in a range from 1 to 9 for the formulated lubricant composition. Metal detergents have been chosen from alkali or alkaline earth calcium or magnesium phenates, sulfonates, salicylates, carbonates and similar components.

Antioxidants have been chosen from hindered phenols, arylamines, dihydroquinolines, phosphates, thiol/thiolester/disulfide/trisulfide, low sulfur peroxide decomposers and other related components. These additives are rich in sulfur, phosphorus and/or ash content as they form strong chemical films to the metal surfaces and thus need to be used in limited amount in reduced sulfur, ash and phosphorous lubricating oils.

Inhibitors and antirust additives may be used as needed. Seal swell control components and defoamants may be used with the mixtures of this invention. Various friction modifiers may also be utilized. Examples include but are not limited to amines, alcohols, esters, diols, triols, polyols, fatty amides, various molybdenum phosphorodithioates (MoDTP), molybdenum dithiocarbamates (MoDTC), sulfur/phosphorus free organic molybdenum components, molybdenum trinuclear components, and any combination thereof.

Suitable friction modifiers include phosphanate esters, phosphite esters aliphatic succinimides, molybdenum compounds and acid amides. U.S. Pat. No. 6,1184,186 a lubricant composition comprising a molybdenum carboxylate and sulfurized isobutylene extreme pressure agent can reduce micropitting in gears.

EXAMPLES

We have discovered several novel formulations that provide enhanced micropitting protection. These formulations are shown below in Table 3 as Examples 1 through 6. A commercially available gear oil package is shown for reference as example 7. All lubricant formulations in Table 1 are blended to International Standard Organization ("ISO") viscosity grade 320. Viscosity grade 320 is the predominant recommendation from most wind turbine builders.

TABLE 3

| | Example: | | | | | | |
|---|---|---|---|---|---|---|---|
| Component | 1 | 2 | 3 | 4 | 5 | 6 | 7 |
| Adipate Ester | 10.00 | 10.00 | 10.00 | 10.00 | 10.00 | 10.00 | 10.00 |
| PAO 2 cSt | 14.00 | 14.00 | — | — | — | — | — |
| PAO 4 cSt | — | — | 18.00 | 18.00 | 18.00 | 18.00 | — |
| PAO 6 cSt | — | — | — | — | — | — | 22.00 |
| PAO 100 cSt | — | — | — | — | 34.10 | 34.15 | 64.60 |
| High viscosity index PAO 150 cSt | 73.10 | 73.15 | 69.10 | 69.15 | 35.00 | 35.00 | — |
| Gear Oil Package 1 | 2.90 | — | 2.90 | — | 2.90 | — | — |
| Gear Oil Package 2 | — | 2.85 | — | 2.85 | — | 2.85 | — |
| Gear Oil Package 3 | — | — | — | — | — | — | 3.40 |

Table 4 illustrates the micropitting protection of the seven examples from Table 3. As shown in Table 3, Examples 1 and 2 include the respective assemblage of additives from gear oil package 1 in Example 1 or gear oil package 2 in Example 2. Both Example 1 and 2 have adipate ester dissolved in a wide "bi-modal" hydrocarbon blend of high viscosity index PAO 150 cSt and PAO 2. Table 2 demonstrates these "bi-modal" blends and additives result in outstanding micropitting results. Examples 3 and 4 demonstrate that the assemblage of additives from gear oil package 1 in Example 3 or gear oil package 3 in Example 4. Both examples have adipate ester dissolved in a wide "bi-modal" hydrocarbon blend of high viscosity index PAO 150 cSt and PAO 4. Table 3 shows outstanding micropitting results with these "bi-modal" blends and additives. Additionally, Examples 5 and 6 from table 1 are three component lubricant base stocks with high medium and low viscosities base stocks. These base stocks are mixed the assemblage of additives from gear oil package 1 in Example 5 or gear oil package 2 in Example 6 with adipate ester dissolved in a wide "bi-modal" hydrocarbon blend of high viscosity index PAO 150 cSt and PAO 4 in combination with PAO 100. This three component base stock lubricant also provides outstanding micropitting benefits as shown in table 3.

TABLE 4

| Example | Profile Deviation (7.5 mm maximum) |
|---|---|
| 1 | 6.7 |
| 1 (repeat) | 5.9 |
| 2 | 6.1 |
| 2 (repeat) | 7.2 |
| 3 | 4.5 |
| 4 | 7.2 |
| 5 | 4.4 |
| 6 | 7.2 |
| 7 (reference) | 9.5 |

In addition to the above examples, The following base stock combinations give enhanced Micropitting protection: high viscosity index PAO 150 cSt and gas to liquid ("GTL") base stocks or wax derived lubricants, high viscosity index PAO 150 cSt+Group III base stocks, high viscosity index PAO 150 cSt+Group II base stocks, 150 cSt+PAO 100 (with or without Poly Iso Buthylene ("PIB"))+GTL base stocks, high viscosity index PAO 150 cSt+PAO 100 (with or without PIB)+Group III base stocks, high viscosity index PAO 150 cSt+PAO 100 (with or without PIB)+Group II base stocks, high viscosity index PAO 150 cSt+Brightstock (with or without PIB)+GTL base stocks, high viscosity index PAO 150 cSt+Brightstock (with or without PIB)+Group III base stocks, high viscosity index PAO 150 cSt+Brightstock (with or without PIB)+Group II base stocks. In addition, based on the disclosure herein other base stocks of widely disparate viscosities that give a "bi-modal" blending result can also be envisioned with the benefit of the disclosure herein to deliver enhanced micropitting protection to operating gearboxes.

What is claimed is:

1. A lubricating oil, comprising a) at least two base stocks;

b) at least 10 percent and no more than 73.15 percent of a first base stock comprising a synthetic oil with a viscosity greater than 100 cSt, Kv100° C.;

c) at least 5 percent and no more than 30 percent of a second base stock comprising a oil with a viscosity less than 10 cSt, Kv100° C.;

d) a viscosity difference of the first and second base stocks of at least 96 cSt, Kv100° C. wherein the Lubricating oil provides a FVA 54 Micropitting Test Fail Load Stage greater than 10; and c) wherein the lubricant composition has a viscosity of greater than 39 cSt, Kv100° C. and a viscosity index of at least 161.

2. The lubricating oil of claim 1 wherein the second base stock is a synthetic Poly Alpha Olefin with a viscosity less than 10 cSt and greater than 2 cSt, Kv100° C. and the first base stock is a PAO oil with a viscosity less than 300 cSt, Kv100° C.

3. The lubricating oil of claim 1 wherein the first high viscosity base stock is chosen from the group consisting of high viscosity index PAO (150 cSt, Kv100° C.), a synthetic lubricating oil with a viscosity greater than 100 cSt, Kv100° C., a PAO with a viscosity greater than 100 cSt, Kv100° C., and any combination thereof.

4. The lubricating oil of claim 1 wherein the second low viscosity base stack is chosen from the group consisting of GTL lubricants, wax derived lubricants, Poly Alpha Olefin, Brightstocks, Brightstocks with PIB, group II base stocks, group III base stocks, and any combination thereof.

5. The lubricating oil of claim 1 further comprising at least one additive, the additive chosen from the group consisting of antiwear, antioxidant, defoamant, demulsifier, detergent, dispersant, metal passivator, friction reducer, rust inhibitor, and any combination thereof.

6. The lubricating oil of claim 1 further comprising a third base stock and the first base stock is no more than 60 percent of the lubricating oil.

7. The lubricating oil of claim 6, wherein the third base stock is chosen from a group consisting of a PAO with a viscosity of at least 6 cSt, Kv100° C. and no more than 100 cSt, Kv100° C., ester base stock, alkylated aromatic and any combination thereof.

8. The lubricating oil of claim 6 wherein the first base stock has a viscosity greater than 100 cSt, Kv100° C., the second base stock has a viscosity of less than 6 cSt and the third base stock has a viscosity of at least 6 cSt and no more than 100 cSt, Kv100° C.

9. The lubricating oil of claim 1 further comprising at a third and fourth base stock, the third base stock comprising a PAO having a viscosity of at least 6 cSt and less than 100 cSt, Kv100° C., the fourth base stock comprising an alkylated aromatic base stock.

10. The lubricating oil of claim 9 further comprising an additive chosen to obtain favorable lubricant properties for gear oil protection.

11. The lubricating oil of claim 1 wherein the first base stock is less than 300 cSt, Kv100° C.

12. The lubricating oil of claim 1 wherein the first base stock is at least 125 cSt, Kv100° C. and less than 300 cSt, Kv100° C.

13. The lubricating oil of claim 1 wherein the second base stock has a viscosity greater than 2 cSt, Kv100° C.

14. The lubricating oil of claim 1 further comprising an alkylated aromatic and an additive package.

15. A method of blending a lubricating oil, comprising, a) obtaining a first synthetic base stock lubricant the first base stock having a viscosity greater than 100 cSt, Kv100° C.;

b) obtaining a second synthetic base stock lubricant, the second base stock lubricant has a viscosity less than 10 cSt, Kv100° C.;

c) mixing the first and second base stock lubricant to produce the lubricating oil wherein the lubricating oil provides a FVA 54 Micropitting Test Fail Load Stage greater than 10 and the lubricating oil having a viscosity greater than 38 cSt, Kv100° C. and a viscosity index greater than 161.

16. The method of claim 15 further comprising obtaining a third base stock, the third base stock having a viscosity greater than 6 cSt, Kv100° C. and less than 100 cSt, Kv100° C. and mixing the third base stock lubricant with the first and second base stock lubricants to create the lubricating oil.

17. The method of claim 15 further comprising obtaining a fourth base stock comprising an alkylated aromatic and mixing the fourth base stock with the first, second and third base stocks to produce the lubricating oil.

18. The method of claim 15 further comprising adding additives to the lubricating oil to achieve favorable gear oil properties of the lubricant.

19. The method of claim 15 wherein the high viscosity base stock is chosen from the group consisting of high viscosity index PAO 150 (150 cSt, Kv100° C.), a synthetic lubricating oil with a viscosity greater than 100 cSt, Kv100° C., a PAO with a viscosity greater than 100 cSt, Kv100° C., and any combination thereof.

20. The method of claim 15 wherein the second low viscosity base stock is chosen from the group consisting of GTL lubricants, wax derived lubricants, Poly Alpha Olefin, Brightstocks, Brightstocks with PIB, groan II base stocks, group III base stocks, and any combination thereof.

21. The method of claim 15 further comprising an additive, the additive chosen from the group consisting of antiwear, antioxidant, defoamant, demulsifier, detergent, dispersant, metal passivator, friction reducer, rust inhibitor, and any combination thereof.

22. The method of achieving favorable micropitting protection comprising, a) obtaining a lubricating oil comprising at least two base stocks, at least 10 percent and no more than 73.15 percent of a first base stock comprising a synthetic oil with a viscosity greater than 100 cSt, Kv100° C. at least 5 percent and no more than 30 percent of a second base stock comprising an oil with a viscosity less than 10 cSt, Kv100° C., wherein the lubrication oil provides a FVA 54 Micropitting Test Fail Load Stage greater than 10, the lubricating oil having a viscosity greater than 38 cSt, Kv100° C. and a viscosity index greater than 161; and b) lubricating at least on gear with the lubricating oil.

* * * * *